United States Patent [19]

Morgan et al.

[11] Patent Number: 4,700,850

[45] Date of Patent: Oct. 20, 1987

[54] ROTATABLE STORAGE DEVICE

[75] Inventors: Tamara M. Morgan, 146 Juniper Dr., Freehold, N.J. 07728; Richard R. Roig, Oak Ridge; Michael Hrehovcik, Little Falls, both of N.J.

[73] Assignee: Tamara M. Morgan, Freehold, N.J.

[21] Appl. No.: 811,288

[22] Filed: Dec. 20, 1985

[51] Int. Cl.[4] ..... A47F 5/02

[52] U.S. Cl. ..... 211/131; 211/78; 211/144; 211/163

[58] Field of Search ..... 211/131, 129, 163, 144, 211/78, 77; 108/94, 139

[56] References Cited

U.S. PATENT DOCUMENTS

| | | | |
|---|---|---|---|
| 3,698,779 | 10/1972 | Holmes et al. | 108/94 X |
| 4,030,608 | 6/1977 | Howard | 211/144 X |
| 4,216,867 | 8/1980 | Sturm | 211/77 |
| 4,249,318 | 2/1981 | Anderson et al. | 211/78 X |

FOREIGN PATENT DOCUMENTS

| | | | |
|---|---|---|---|
| 857762 | 12/1970 | Canada | 211/131 |
| 1062494 | 12/1953 | France | 211/131 |
| 1424822 | 12/1965 | France | 211/144 |
| 90752 | 1/1958 | Norway | 211/144 |

*Primary Examiner*—Robert W. Gibson, Jr.
*Attorney, Agent, or Firm*—Donald R. Andersen

[57] ABSTRACT

An improved rotatable portable storage device including a plurality of annular intermediate storage sections which are removeably attached and further including a top section having a handle for carrying the device and a rotatable base section for supporting the device. The annular intermediate storage sections include a semicircular storage compartment at the core of each section, such that the intermediate sections may be stacked in angular relation to each other to provide a plurality of central storage compartments having varying depths.

13 Claims, 5 Drawing Figures

ROTATABLE STORAGE DEVICE

BACKGROUND OF THE INVENTION

This invention relates to the art of providing a compact portable rotatable storage device in which the objects stored are easily accessible and in which the storage device is easily adaptable to varying storage requirements.

In recent years, many people have taken up the hobby of decorative art painting. Decorative art painting involves painting decorative designs on many common household objects and handicrafts, such as woodworking, pottery, and other art objects.

A major problem that these artists encounter is organizing all of the different color bottles and tubes of paint so that the bottles are easily identifiable and accessible when working.

Another problem which these artists encounter is the need to transport their paints and supplies when attending art shows and classes. Paint chests and drawers, particularly paint chest and drawers having enough space to arrange and organize a large number of paint bottles, are bulky and difficult to transport.

A still further problem is that the needs of decorative artists to have certain paints available to them often change depending upon the artist or depending upon the project. The decorative artists therefore have varying needs for storage space, while most existing storage chests and drawers are not easily adapted for changing such storage requirements, and require that all of the stored bottles and tubes be transported together.

Finally, even when the storage device is adapted to organize and store the desired number of paint bottles, the current storage devices often take up a large portion of the work area or of the available storage space.

SUMMARY OF THE INVENTION

It is an object of the present invention to provide an improved storage device in which the objects to be stored are easily accessible.

It is a further object of the present invention to provide an improved storage device easily adaptable and expandable for storage of different numbers of objects.

It is still a further object of the present invention to provide an improved storage device which is compact and which provides maximum storage in minimum space, while at the same time providing for easy accessibility of the stored objects.

It is an additional object of the present invention to provide an improved storage device which is easily transportable.

The foregoing objects and still other objects and advantages of the present invention will become apparent upon reading the following specification describing one preferred embodiment of the invention and also by reading the claims and referring to the following drawings in which the numbered parts of the embodiment described in the specification are shown by like numbered parts in the drawings.

BRIEF DESCRIPTION OF THE DRAWINGS

FIG. 1 is a perspective drawing showing a preferred embodiment of the improved rotatable storage device in assembled condition.

DESCRIPTION OF A PREFERRED EMBODIMENT

Figure 4:
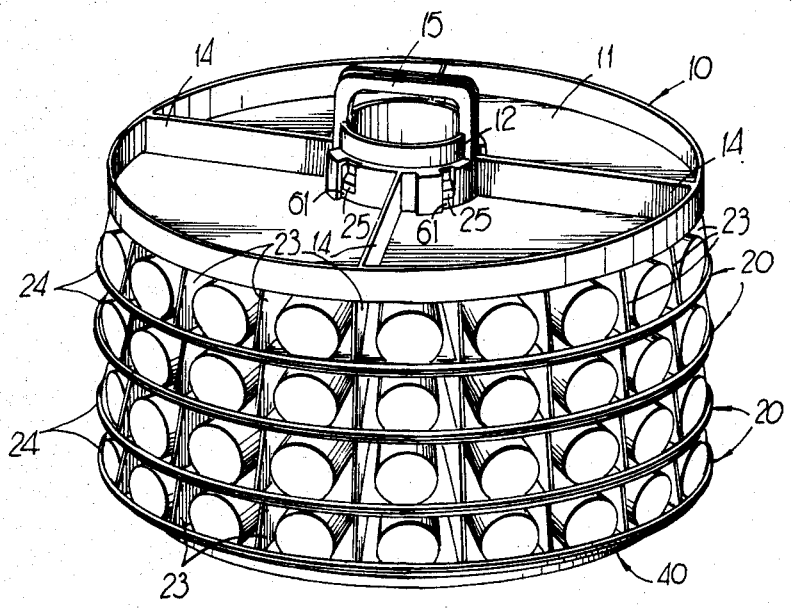
FIG. 4 is a plan drawing showing the bottom view of a preferred embodiment of an intermediate section of the improved rotatable storage device.

The preferred embodiment of the present invention includes at least three elements: an upper section 10, an intermediate section 20, and a base section 40. The three sections 10, 20 and 40 are designed to be stackingly arranged and removeably fastened together to form a preferred embodiment of the improved storage device of the present invention. Additionally, as will be set forth more fully below, as many intermediate sections 20 as are desired can be inserted between the upper section 10 and the bae section 40 in order to provide the desired storage capacity.

Figure 2:
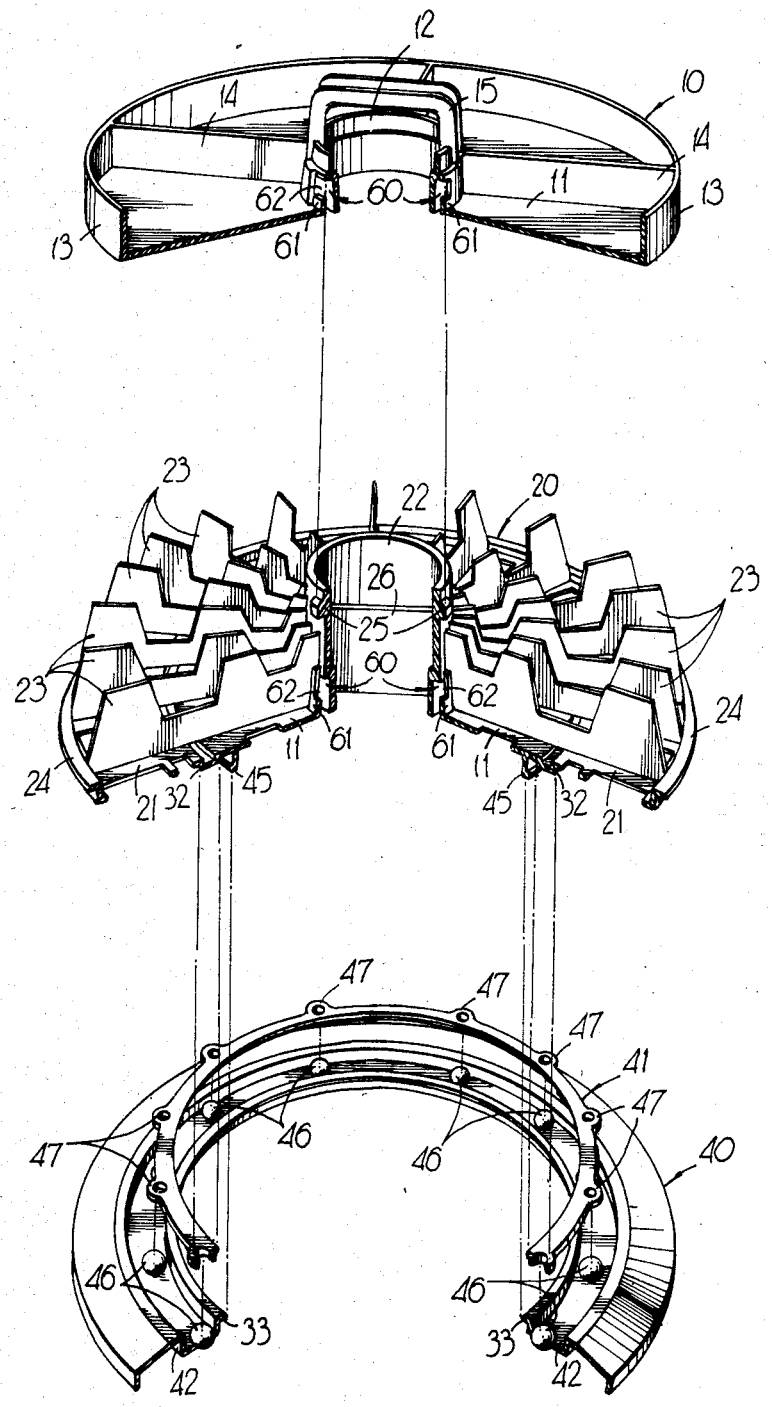
FIG. 2 is an exploded cut-away perspective drawing showing a preferred embodiment of the improved rotatable storage device.

Referring now to FIG. 2, the upper section 10 of the rotatable storage device is shown. The upper section 10 includes an annular floor 11 which is affixed to a central vertical collar 12. The top and bottom surface of the annular floor 11 is substantially flat, and an outer circumferential wall 13 surrounds the outer circumference of the annular floor 11 and a plurality of radially arranged vertical walls 14 extend radially from the central vertical collar 12 to the outer vertical circumferential wall 13 to provide storage trays.

The central vertical collar 12 extends vertically above the annular floor 11, and includes a handle 15 for transporting the improved rotatable storage device. The central vertical collar 12 also includes an engagement means for stackingly engaging the central vertical collar 22 of the subjacent intermediate section 20. The engagement means will be described more fully below in connection with the description of the intermediate section 20.

Referring again to FIG. 2, intermediate section 20 includes an annular floor 21 and a central vertical collar 22. Extending radially from the central vertical collar 22 are a plurality of vertical radial dividers 23 which extend vertically to a height immediately below the annular floor 11 of the upper section 10 or the annular floor 21 of a superjacent intermediate section 20 to define a plurality of radial storage compartments of the intermediate piece 20. The outer circumference of the annular floor 21 is surrounded by a circumferential vertical lip 24 which extends vertically from the annular floor 21 and engages the outer edges of the dividers 23. The circumferential vertical lip 24 provides a circumferential barrier for further restraining objects stored in the individual radial storage compartments.

The central vertical collar 22 is adapted to permit the intermediate section 20 to be stackingly and removably attached to the central vertical collar 12 of the upper section 10 or the central vertical collar 22 of a superjacent intermediate section 20. The central vertical collar 22 includes a plurality of exterior tabs 25 spaced equidistantly around the upper circumference of the central vertical collar 22. As shown in FIGS. 1, 2 and 4, only two of the tabs 25 are visible, but the reverse views of such figures are identical and it will be understood that is the perferred embodiment there are four tabs 25 spaced equidistantly around the central vertical collar 22. The tabs 25 are intended to engage the attachment means of the central vertical collar 12 of the upper section 10 or the attachment means of the central vertical collar 22 of a superjacent intermediate section 20. Again, only two of the form attachment means of the upper section 10 are shown, but it will be understood that the reverse views are identical to the views shown. All form of the attachment means are shown in part in the bottom view of an intermediate section 20 shown in FIG. 4.

Figure 3:
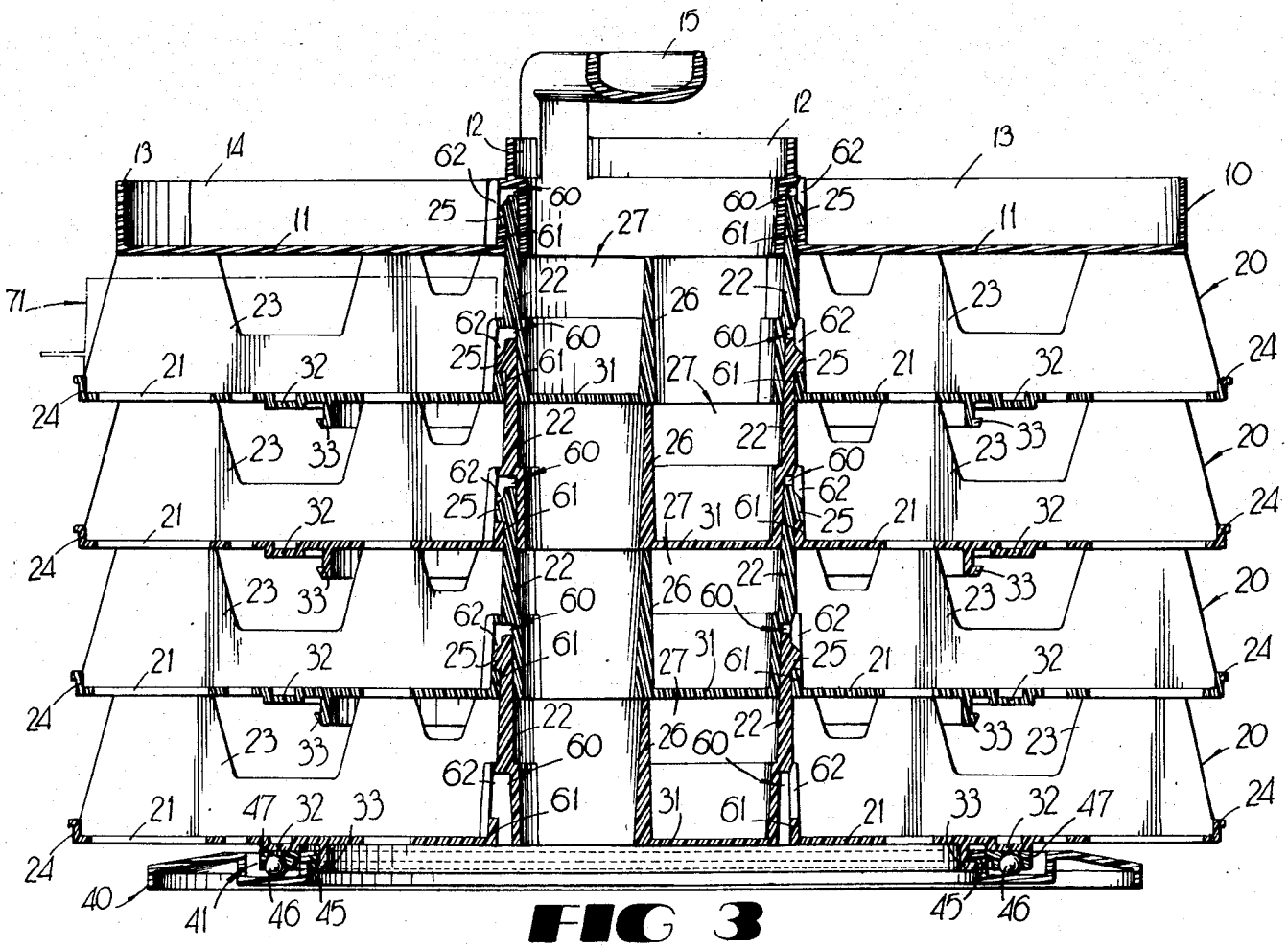
FIG. 3 is a vertical cross-section drawing showing a representative cross-section of a preferred embodiment of the improved rotatable storage device.
Figure 4:
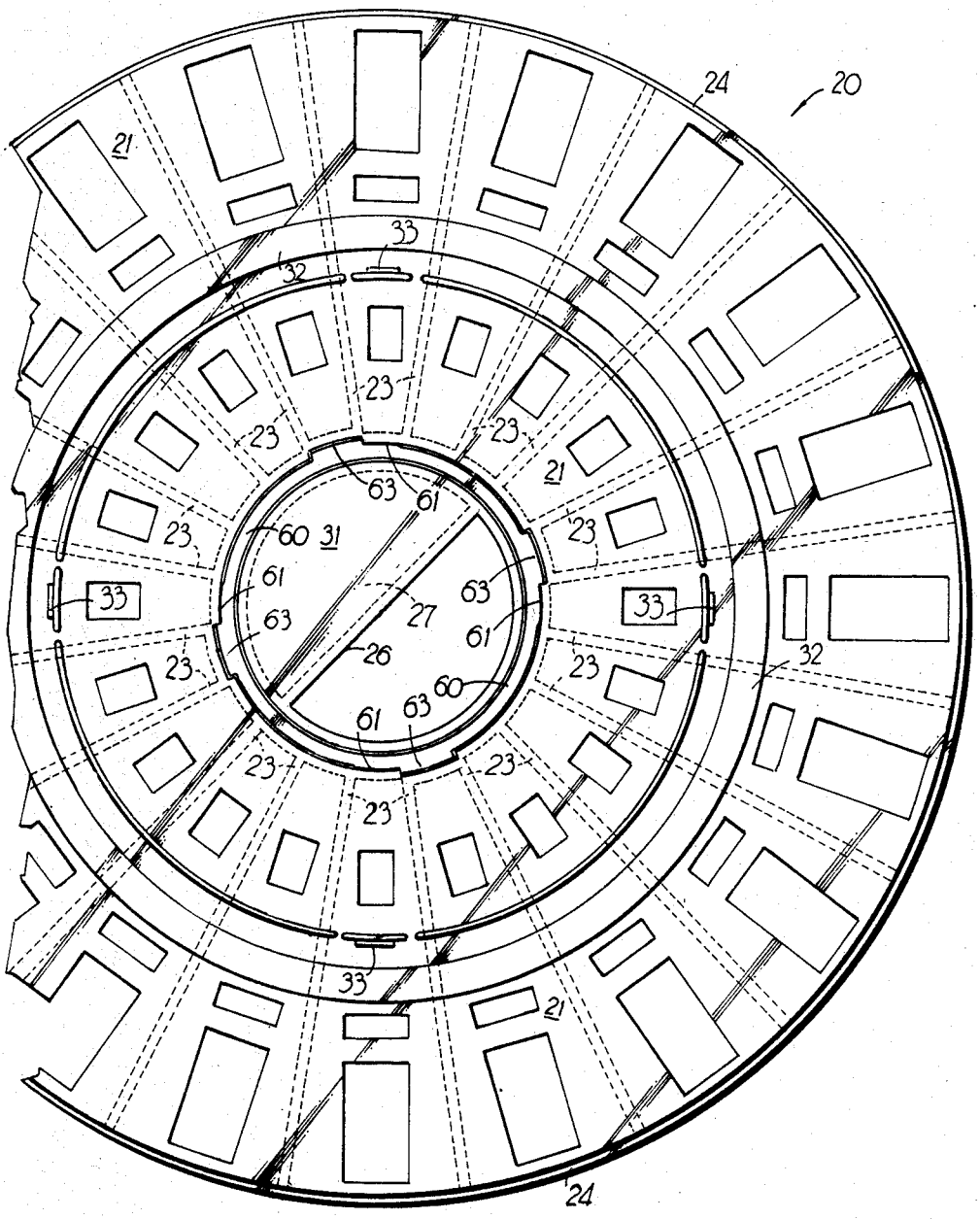

Referring now to FIGS. 2–4, it will be seen that the central vertical collar 12 of the upper section 10 and the central vertical collar 22 of the intermediate section 20 both include a circumferential space 60 around the outer circumference of the lower portions of the central vertical collars 12 and 22. Within the circumferential spaces 60 are located a plurality of locking slots 62 and locking tabs 61 spaced equidistantly around the circumferential space 60 at the same distances as the vertical tabs 25.

In operation, the foregoing locking slots and locking tabs 61 provide the attachment means for the respective central vertical collars 12 and 22 which permit the stacked sections to be removably affixed in a stacking relationship to one another as shown in FIG. 1. As shown more fully in FIGS. 3 and 4, such attachment is achieved by aligning the locking tabs 25 of the intermediate section 20 to the alignment slots 63 of the vertical collar 12 or 22 of the superjacent upper section 10 or intermediate section 20, and inserting the central vertical collar 22 of the lower intermediate section into the circumferential space 60 of the upper section 10 or a superjacent intermediate section 20 until the upper section 10 or the superjacent intermediate section 20 rests on the central vertical collar 22 of the lower intermediate section 20. The upper section 10 or superjacent intermediate section 20 is then twisted in relation to the lower intermediate section 20 such that the vertical tabs 25 slide horizontally into the locking slots 62 and fully engage the locking tabs 61 and secure the upper section 10 or superjacent intermediate section 20 in stacking relationship to the lower intermediate section 20.

Referring now to FIG. 4, the bottom portion of the intermediate section 20 is shown. But, before describing FIG. 4, FIG. 2 should be examined and it will be noted that the interior of the annular core defined by the central vertical collar 22 is open at the top of the collar 22. Returning to FIG. 4, at the bottom of the annular core is a horizontal core floor segment 31 which bisects the annular core. In the preferred embodiment shown in FIG. 4, the horizontal core floor segment 31 is in the shape of a half circle which covers half the area of the core. As also shown in FIG. 2, the straight edge of the horizontal core floor segment 31 is attached to vertical wall segment 26 which extends upwardly from the floor segment 31 within the annular collar 22. Thus, the interior wall of the central vertical collar 22, the horizontal core floor segment 31, and the vertical wall segment 26 define a vertical semi-cylindrical storage compartment 27 within the annular collar 22.

In operation, the semi-cylindrical storage compartments 27 of at least two intermedite sections 20 stacked one on top of the other may be locked in angular relation to one another to provide two semi-cylindrical storage compartments of two different depths. If at least three intermediate sections 20 are stacked one on top of the other, such intermediate sections 20 may be locked in angulr relation to one another to provide either two semi-cylindrical storage compartments having two different depths or one semi-cylindrical storage compartment and two quarter-cylindrical storage compartments, with all of the storage compartments having different depths.

Referring again to FIG. 4, the bottom of the intermediate section 20 further includes a circular track 32 and a plurality of locking tabs 33 for engaging central locking means 45 of the base section 40 and for engaging the circular bearing race 41 affixed to the top of the base section 40.

Referring now to FIG. 2, the base section 40 includes central locking means 45 for being stackingly and removably attached to a superjacent intermediate section 20. As set forth above, the base section 40 also includes a lower circular bearing race 41 for engaging a plurality of bearings 46 held in place by an upper circular bearing race 47 which when the base section 40 is assembled to a superjacent intermediate section 20 engages the annular track 32 on the bottom of the intermediate section 20.

Referring again to FIG. 1, an assembled rotatable storage device is shown. It will be understood that the number of intermediate section 20 may be varied and increased to provide for varying and expanded storage requirements. Additionally, if only a portion of the stored objects are to be transported or used, the intermediate sections containing the desired objects may be removed and attached to the upper piece 10 and the bottom piece 40 and transported and used separately. Additionally labels may be affixed to the outer circumferential wall 13 and outer circumferential lip 24 in order to label the contents of the objects stored in the rotatable storage device.

Figure 5:
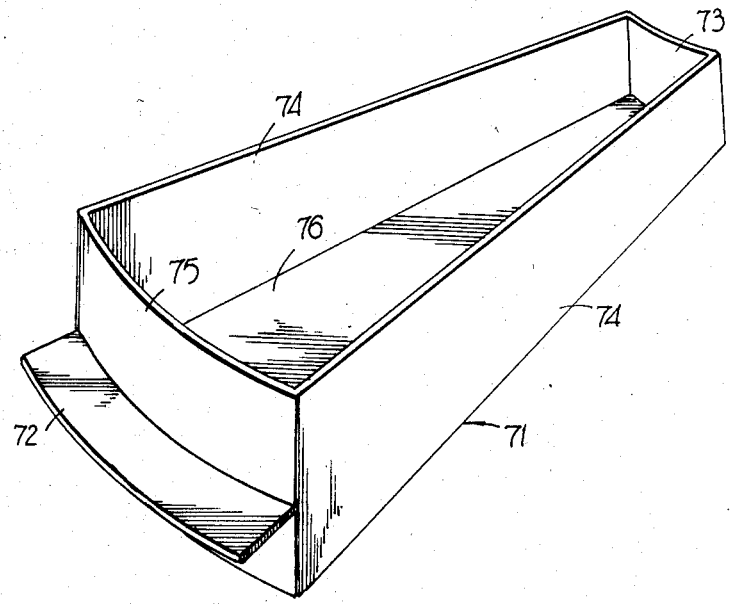
FIG. 5 is a perspective drawing showing a preferred embodiment of a removable storage compartment of the present invention.

Referring now to FIG. 5, a storage compartment 71 is shown. The storage compartment includes a floor 76, radial walls 74 and inner wall 73 and outer wall 75, and the storage compartment 75 is wedge-shaped in order to fit within the storage sections of the rotatable storage device. The storage compartment 71 may include a handle or tab 72 on outer edge of the storage compartment 71 in order to facilitate replacement and removal of the storage compartment 71. By using the storage compartments 71, the present invention may be used for storing nuts, bolts, washers, grains, spices and other small objects.

The preferred embodiment of the top section 10 and intermediate sections 20 of the rotatable storage device are made from transparent high strength plastic. Of course, it will be understood that such sections of the rotatable storage device may be made of other suitable materials, but is has been found that molded transparent high strength plastic is preferable because of ease of manufacture and because it also has the desired characteristic of being lightweight.

Exemplary of the materials which may be chosen based on desired cost, weight and strength are K-resin, general purpose (GP) styrene, ABS (a high impact plastic), and polypropylene. It will also be noted that for clarity of detail, the drawings do not show a transparent material and such transparent material is not necessary, but merely preferred for use in the present invention. The base section 40 is not generally transparent and preferably is made from a suitable, lightweight high strength plastic adapted for carrying in rotating relationship a plurality of intermediate sections 20. From the foregoing description it will be seen that the preferred embodiment of the present invention disclosed herein provides a compact, lightweight rotatable storage device, which has superior storage capabilities and which can be easily adapted to varying storage requirements. It will be understood, howerver, by those skilled in the art that the present invention encompasses embodiments of the present invention in addition to the preferred embodiment set forth above, and that the preferred embodiment of the invention described above is merely illustrative and that the scope of the present invention is limited solely by the appended claims.

Wherefore, I claim the following:

1. An improved storage device including:

(a) a rotating base;

(b) a first storage tray having a circular exterior dimension removably attached to said rotating base.

(c) a second storage tray having a circular external dimension, said second storage tray being situated on top of said first storage tray and removably attached to said first storage tray.

(i) said first storage tray including an annular core extending up from the base of said first storage tray, said annular core including a plurality of circumferential attachment tabs; and (ii) said second storage tray including an annular recess in the bottom of the base of said second storage tray, said annular recess being adapted for receiving said annular core of said first tray and further including means for accepting said circumferential attachment tabs and for removably latching said circumferential attachment tabs within said annular recess.

2. An improved storage device as claimed in claim 1, wherein said first storage tray includes a plurality of radially arranged storage compartments accessible from the circumferential edge of said first storage tray.

3. An improved storage device as claimed in claim 1, wherein said first tray is annular in shape and said first tray includes a storage compartment in the center of said first storage tray.

4. An improved storage device as claimed in claim 1, wherein said second storage tray includes a plurality of radially arranged storage compartments accessible from the circumferential edge of said second storage tray.

5. An improved storage device as claimed in claim 1, wherein said first tray is annular in shape and said first tray includes a storage compartment in the center of said first storage tray.

6. An improved storage device as claimed in claim 5, wherein said second tray is annular in shape and said second tray includes a storage compartment in the center of said second storage tray.

7. An improved storage device as claimed in claim 6, wherein said storage compartment in the center of said first storage tray is semi-circular, and said storage compartment in the center of said second storage tray is semi-circular.

8. An improved storage device, including:

(a) a rotatable base;

(b) a first annular storage tray attached to said rotatable base, said first annular storage tray including a semi-circular storage compartment in the center of said first annual storage tray and further including a plurality of radially arranged storage compartments extending radially from the core of said first annular storage tray to the circumference of said first annular storage tray, said radially arranged storage compartments being accessible from the circumferential side of said first annular storage tray;

(c) a second annular storage tray situated above said first annular storage tray, said second annular storage tray including a semi-circular storage compartment in the center of said second annular storage tray and further including a plurality of radially arranged storage compartments extending radially from the core of said second annular storage tray to the circumference of said second annular storage tray, said radially arranged storage compartments being accessible from the circumferential said of said second annular storage tray; and (d) wherein the means for removable attachment of said first storage tray and said second storage tray includes:

(i) said first storage tray including an annular core extending up from the base of said first storage tray, said annular core including a plurality of circumferential attachment tabs; and (ii) said second storage tray including an annular recess in the bottom of the base of said second storage tray, said annular recess being adapted for receiving said annular core of said first storage tray and further including means for accepting said circumferential attachment tabs and for removably latching said circumferential attachment tabs within said annular recess.

9. An improved storage device, including:

(a) a first storage level having a floor; and (b) a second storage level having only a partial floor; and (c) attachment means for removably attaching said second storage level in vertical relation to said first storage level.

(d) a first storage level and a second storage level which are circular and said attachment means being further adapted for removably attaching said second storage level in at least two different horizontal angular relationships with said first storage level to provide an improved storage device having a floor at the first storage level and a partial floor at the second storage level.

(e) a first storage level having an interior wall extending upwardly from the floor of said first storage level to the bottom of said second storage level to form a storage compartment within said first storage level.

10. An improved storage device as claimed in claim 9, wherein said second storage level includes an interior wall extending upwardly from said partial floor of said second storage level to form a storage compartment at said second storage level.

11. An improved storage device as claimed in claim 10, wherein said floor of said first storage level is semi-circular.

12. An improved storage device as claimed in claim 11, wherein said interior wall of said second storage level bisects said second storage level.

13. An improved storage device as claimed in claim 12, wherein said attachment means is further adapted for removably attaching said second storage tray in at least two different horizontal angular relationships with said first storage tray to provide an improved storage device having a partial floor at the first storage level and a partial floor at the second storage level.

* * * * *